United States Patent [19]

Cristobal et al.

[11] 4,320,026

[45] Mar. 16, 1982

[54] ALKALINE DETERGENT COMPOSITION AND METHOD OF INHIBITING DISCOLORATION OF SAID DETERGENT COMPOSITION

[75] Inventors: Fely B. Cristobal, Fremont, Calif.; Robert W. Newsbaum, Mahopac, N.Y.

[73] Assignee: Brent Chemicals Corporation, Stamford, Conn.

[21] Appl. No.: 965,560

[22] Filed: Dec. 1, 1978

[51] Int. Cl.[3] ..... C11D 1/72; C11D 3/075; C11D 3/10; C11D 3/43

[52] U.S. Cl. ..... 252/139; 252/135; 252/158; 252/173; 252/174.21; 252/174.22; 252/407; 252/DIG. 1; 568/580; 568/581

[58] Field of Search ..... 568/580, 581; 252/139, 252/158, 173, 174.21, 174.22, 407, DIG. 1, DIG. 10, DIG. 14, 399

[56] References Cited

U.S. PATENT DOCUMENTS

| | | | |
|---|---|---|---|
| 3,037,936 | 6/1962 | Tidridge | 252/139 |
| 3,914,185 | 10/1975 | Inamorato | 252/546 |
| 3,931,033 | 1/1976 | Lohr | 252/122 |
| 3,954,648 | 5/1976 | Belcak | 252/158 |
| 4,048,121 | 9/1977 | Chang | 252/527 |
| 4,152,305 | 5/1979 | Berghausen | 252/523 |

*Primary Examiner*—Dennis L. Albrecht

*Attorney, Agent, or Firm*—St. Onge, Steward, Johnston, Reens & Noë

[57] ABSTRACT

An improved alkaline detergent composition is provided having a reduced tendency to discolor upon aging at room temperature and/or elevated tempertures. The detergent composition contains:

(a) an alkali material such as alkali metal hydroxides, alkali metal silicates and mixtures thereof; and (b) at least one nonionic surface active agent having a tendency to discolor the composition in the presence of such alkaline material. The improved composition contains a discoloring inhibiting amount of an alcohol of 3 to 10 carbon atoms, preferably 3 to 6 carbon atoms, having not more than one primary alcohol group and at least one secondary or tertiary alcohol group, e.g. 2-methyl-2,4-pentanediol, and 1,2-propanediol.

A method is also provided for inhibiting the discoloration of such alkaline detergent composition by adding a discoloring inhibiting amount of the aforementioned alcohol to the composition.

36 Claims, No Drawings

ALKALINE DETERGENT COMPOSITION AND METHOD OF INHIBITING DISCOLORATION OF SAID DETERGENT COMPOSITION

BACKGROUND OF THE INVENTION

1. Field of the Invention

This invention relates to detergent compositions and in particular to alkali containing detergent compositions containing nonionic surface active agents which have a tendency to discolor the compositions in the presence of such alkali.

2. Description of the Prior Art

Compositions intended primarily for laundering heavily soiled fabrics generally contain two essential compounds: a builder and a surface active agent. Widely used builder materials include alkali materials such as alkali metal hydroxides, alkali metal silicates and the like. Due to the increasing concern for the conservation of energy, there have been developed certain highly alkaline detergent compositions which perform satisfactorily, particularly in commercial laundering operations, at low washing solution temperatures, i.e., less than about 140° F. (60° C.). A particularly preferred composition is described in U.S. Application Ser. No. 911,589 to Cristobal, Newsbaum and Baylog, filed on May 31, 1978, the entire disclosure of which is incorporated herein by reference. A problem associated with these highly alkaline detergent compositions is that the nonionic surface active agents employed therein tend to discolor the compositions in the presence of such high alkalinity and impart, for example, a dark brown color to the detergent composition upon aging at room temperature and/or elevated temperatures. This is highly undesirable for the commercial sale of the product.

SUMMARY OF THE INVENTION

Accordingly, it is an object of this invention to provide an improved alkaline detergent composition having a reduced tendency to discolor.

It is a particular object of this invention to provide an improved non-phosphate to low-phosphate containing alkaline detergent composition having a reduced tendency to discolor, which is used for removing soil from fabrics, (particularly heavily soiled fabrics) at low washing temperatures.

These and other objects are achieved by the improved alkaline detergent composition of this invention which has a reduced tendency to discolor.

The alkaline detergent composition contains:

(a) an alkali material selected from the group consisting of alkali metal hydroxides, alkali metal silicates, and mixtures thereof; and (b) at least one nonionic surface active agent having a tendency to discolor the composition in the presence of the alkali material; the improvement wherein the composition comprises a discoloring inhibiting amount of an alcohol of 3 to 10 carbon atoms having not more than one primary alcohol group and at least one secondary or tertiary alcohol group.

This invention is also directed to a method of inhibiting the discoloration of an alkaline detergent composition containing the aforementioned nonionic surface active agent, by adding a discoloring inhibiting amount of the aforementioned alcohol.

DETAILED DESCRIPTION OF THE INVENTION

Certain detergent compositions having an alkali material, and at least one nonionic surface active agent, tend to discolor upon aging at room and/or elevated temperatures. This discoloring is produced by the contact of the surface active agent with the alkaline material. Not all nonionic surface active agents tend to discolor the composition.

This discoloring usually occurs in conventional alkaline detergent compositions which have at least about 30% by weight of alkali material, but may exist in compositions with lower alkaline material content.

The term "alkali material" is meant to include alkali metal hydroxides, alkali metal silicates, and the like. Preferably, these alkali materials are used in combination with each other, the choice of the particular alkali materials used and their specific amounts depending upon the properties which are desired in the detergent composition.

By the use of the term "alkali metal" as used throughout this specification, it is meant the elements of the first group of the periodic system, i.e., lithium, sodium, potassium, rubidium, or cesium. Sodium is the particularly preferred alkali metal for all constituents, for both cost and efficiency, e.g. sodium hydroxide, sodium metasilicate, and the like. It will be appreciated, however, that in some instances, similar compounds of the other alkali metals such as potassium, lithium, cesium or rubidium may also be used.

It has been noticed that certain types of nonionic surface active agents tend to cause discoloration. Particularly preferred nonionic surface active agents which may tend to cause such discoloration are:

TYPE A—The condensation product of an aliphatic alcohol (preferably $C_8$ to $C_{22}$) with ethylene oxide, propylene oxide or mixtures thereof (preferably 6 to 15 units of ethylene oxide per molecule are utilized).

TYPE B—The condensation product of an alkyl phenol (preferably with about 6 to 16 carbon atoms in the alkyl group) with ethylene oxide (preferably 6 to 25 units of ethylene oxide per molecule).

Widely used Type A nonionic surface active agents are Tergitol Min-Foam 2X and Tergitol 15-S-9 from Union Carbide and Neodol 91-6 and 25-9 from Shell Chemical. Widely used Type B nonionic surface active agents are Surfonic N-95 and N-60 from Jefferson Chemical, with Surfonic N-95 being most preferred.

The Type A surface active agents may be characterized by the following structural formula:

$$CH_3-(CH_2)_x-(OCH_2CH_2-)_nOH \quad \text{(using linear primary alcohols)}$$

wherein "x" is an integer having an average value of from 7 to 21, and wherein "n" is an integer having an average value of from about 6 to 15; or $$\begin{array}{l} CH_3-(CH_2)_x-CH_3 \\ \quad\quad\;\; | \\ \quad\quad\;\; O-(CH_2CH_2O)_nH \end{array} \quad \text{(using linear/secondary alcohols)}$$

wherein "x" is an integer having an average value of from about 5 to 19, and wherein "n" is an integer having an average value of from about 6 to 15.

The Type B surface active agents may be characterized by the following structural formula:

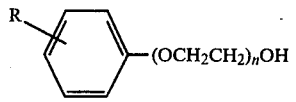

wherein "R" is an alkyl radical containing from about 6 to 16 carbon atoms, and wherein "n" is an integer having an average value of from about 6 to 25.

Surface active agents of the above identified compositions are usually water soluble.

At least one nonionic surface active agent is present in the detergent composition. A mixture of nonionic surface active agents however, may also be used. Preferably, the nonionic surface active agent is a non-ionic surface active agent which is the condensation product of an alkyl phenol with ethylene oxide (Type B).

The total concentration of nonionic surface active agents or mixtures thereof is generally at least about 1% and preferably within the range of from 7% to about 25%, and most preferably from about 8% to about 15% by weight. Any more than about 20% by weight of the surface active agent is considered uneconomical.

Preferred alcohols used in this invention are those having from 3 to 6 carbon atoms. Particularly preferred alcohols are 2-methyl-2,4-pentanediol and 1,2 propanediol.

The alcohol is present in the improved detergent composition of this invention in sufficient quantity to inhibit the discoloring of the detergent composition. For general guidance, this discoloring inhibiting amount is about 0.5% to about 3% by weight of the detergent composition, or a weight ratio of nonionic surface active agent to alcohol of about 2:1 to about 50:1. Lower and higher amounts of the alcohol may be utilized depending upon the detergent composition, the particular alcohol utilized and the particular nonionic surface active agent and its degree of tendency to discolor.

Particularly useful detergent compositions which have a tendency to discolor and for which the method of this invention works particularly satisfactorily are the alkaline detergent compositions described in the aforementioned U.S. Patent Application Ser. No. 911,589, filed on May 31, 1978. These alkaline detergent compositions consist essentially of:

(a) about 45% to about 80% of a mixture of an alkali metal silicate and an alkali metal hydroxide, wherein the mixture has a mole ratio of $M_2O:SiO_2$, wherein M is alkali metal, of about 1.25:1 to about 2.25:1;
(b) about 8% to about 35% of an alkali metal carbonate;
(c) Up to about 40% of an alkali metal condensed phosphate; and
(d) about 7% to about 25% of at least one nonionic surface active agent, which is a condensation product of (A) an aliphatic alcohol with ethylene oxide, propylene oxide or mixtures thereof, or (B) an alkyl phenol with ethylene oxide.

These particularly useful compositions have a tendency to discolor upon standing at room temperature and/or elevated temperatures.

Preferably these detergent compositions contain about 50% to about 65% of a mixture of alkali metal silicate and alkali metal hydroxide. The mixture preferably has a mole ratio of $M_2O:SiO_2$ wherein M is alkali metal, of about 1.75:1 to about 2.15:1.

It is preferred, in these preferred compositions, (for cost and efficiency) that the alkali metal silicate be a sodium silicate, preferably a sodium metasilicate. Sodium orthosilicate ($Na_2O:SiO_2$ mole ratio of about 2:1) may also be utilized as an alkali metal silicate, but this is generally considered to be a mixture of sodium metasilicate and sodium hydroxide in sufficient quantities to provide a mole ratio of $Na_2O:SiO_2$ of 2:1. The alkali metal silicate is present in the detergent composition, preferably at about 30% to about 50%, and most preferably about 35% to about 45%.

Any alkali metal hydroxide may be used, although sodium hydroxide is particularly preferred for reasons of cost and efficiency. The alkali metal hydroxide is present in the improved detergent composition, preferably at about 15% to about 30% by weight, and most preferably at about 20% to about 30%.

The preferred improved alkaline detergent composition has contained therein an alkali metal carbonate. The alkali metal carbonate used may be any water soluble carbonate or mixture thereof. Sodium carbonate is particularly preferred for reasons of cost and efficiency. The alkali metal carbonate may be wholly or partially neutralized and thus includes, for example, a sesquicarbonate. The amount of alkali metal carbonate in the detergent composition can vary widely, but should be about 8% to about 35% by weight, and preferably about 10% to about 20% by weight.

The preferred improved detergent composition of this invention contains up to about 40% of an alkali metal condensed phosphate. A typical condensed phosphate useful in this invention includes tetrasodium pyrophosphate, tetrapotassium pyrophosphate, sodium tripolyphosphate, other sodium polyphosphates and the like. Mixtures of these salts can, of course, be used as the condensed phosphate compound. As used in the compositions of the present invention it is particularly preferred that the amount of condensed phosphate in the alkaline detergent composition be up to about 15%. When a non-phosphating alkali detergent composition is desired, this condensed phosphate is eliminated from the alkaline detergent composition. However, optimum cleaning performance is obtained when such condensed phosphate is present in the alkaline detergent composition in a concentration of about 5% to about 15%.

Various other constituents and adjuvants may be present in the improved detergent compositions of this invention including sanitizers, dyes and pigments, foam improvers, foam depressants, fungicides, antioxidants, stabilizers, chelating agents, fluorescent whitening agents and anti-caking agents.

The anti-redeposition agents include natural and synthetic organic gums or resinous materials which aid in maintaining the removed soil and other constituents of the aqueous washing solution in suspension so that they are not deposited on the laundry as the rinse water is drained through it. Such compounds include methyl cellulose, hydroxypropyl methylcellulose, hydroxybutyl methyl cellulose, polyvinyl pyrolidone, polyvinyl alcohol, and mixtures thereof, and similar agents known in the art.

Preferably sodium carboxymethylcellulose is used in the detergent compositions of this invention in an amount of from about 0.1 to about 3 weight percent with about 2. Weight percent being in general sufficient.

The fluorescent whitening agents are members of a well-known class in the detergent art and usually are reaction products of cyanuric chloride and the disodium salt of diamino stilbene disulfonic acid, benzidene sulfonic acids, amino coumarins, diphenyl pyrazoline derivatives or napthotriazolylstilbenes. Such materials are well known. They include cotton brighteners, polyamide brighteners, polyester brighteners and bleach-stable brighteners of the types mentioned, such as those sold as Calcofluor White ALF (American Cyanamid) SOF (Intracolor Corp.), Blancophor PD (GAF), and Tinopal RBS and AMS (Ciba-Geigy Corp.). Preferably, a dimorpholine dianilino derivative fluorescent whitening agent (Tinopal AMS from Ciba-Geigy Corp.) is used in the detergent composition of this invention in an amount of from about 0.03 to about 1 weight percent.

The detergent compositions of this invention may additionally include any of the other usual optional ingredients, for example, perfumes, fabric softening agents, germicides and enzymes.

Additionally, other builders may also be included in the compositions. Such builders will normally be present in small amounts of up to about 10 percent by weight of the composition.

The compositions of the invention are, for example, in powdered, granular or tablet form of semisolid e paste, or they may be liquids. The compositions can be made by conventional processes.

While the compositions are of particular utility in the field of fabric washing, and in particular low temperature heavy duty fabric washing, they can also be used for other cleaning purposes.

The following non-limiting examples are provided to illustrate the invention in greater detail and show specific embodiments of the invention.

EXAMPLE 1A

DETERGENT COMPOSITIONS

Powdered detergent compositions were prepared by mixing the following ingredients:

| | EXAMPLES | |
|---|---|---|
| | Comp. 1[3] | 1 |
| Sodium Metasilicate | 40.6 | 40.6 |
| Sodium Hydroxide | 25.0 | 25.0 |
| Sodium Tripolyphosphate | 10.0 | 10.0 |
| Sodium Carbonate | 12.0 | 12.0 |
| Sodium Carboxymethyl-cellulose (65%) | 2.0 | 2.0 |
| Non-ionic Surfactant | 10.0[1] | 9.0[1] |
| Fluorescent Whitening Agent[2] | .4 | .4 |
| 1,2-Propanediol | 0 | 1.0 |
| $Na_2O/SiO_2$ Mole Ratio | 1.94 | 1.94 |

[1]Nonyphenol-ethylene oxide adduct with an average of 9.5 moles ethylene oxide per mole of nonylphenol (SURFONIC N-95, Jefferson Chemical).
[2]4,4'-Bis[(4-anilino-6-morpholino-S-triazin-2-yl)amino]-2,2'-stilbenedisulfonic acid.
[3]Comparative Example 1.

Upon standing for 24 hours at 50° C., the composition of Comparative Example 1 turned from a yellow/green color (freshly made) to a dark brown (discolored) whereas the composition of Example 1 remained yellow/green (acceptable).

EXAMPLE 1B

The detergent compositions of Comparative Example 1 and Example 1 were tested in an aqueous washing solution at a temperature of 160° (71° C.) on the indicated test fabrics at a concentration of 1.25 grams/liter of aqueous washing solution. The indicated measurements were taken.

| Detergent Composition of Example: | % Soil Removal[(1)] EMPA 101[(2)] |
|---|---|
| Comp. 1 | 52.1 |
| 1 | 51.1 |

[(1)]Determined by measurements with a Hunterlab Model D25 Color-difference Meter by the following formula:

$$\% \text{ Soil Removal} = \frac{L_{after\ (soiled)} - L_{before\ (soiled)}}{L_{before\ (non\text{-}soiled)} - L_{before\ (soiled)}} \times 100$$

[(2)]Additionally soiled with a 30% concentration of used motor oil in xylene.

EXAMPLES 2 AND 3

Powdered detergent compositions were prepared by weighing all the dry components (except sodium carboxymethyl cellulose) and blending. The nonionic surface active agent and the alcohol are then blended in. (The nonionic surface active agent and the alcohol may be premixed prior to adding). The sodium carboxymethyl cellulose is then added.

| | EXAMPLES | | |
|---|---|---|---|
| | Comp. 2[3] | 2 | 3 |
| Sodium Metasilicate | 40.6 | 40.6 | 40.6 |
| Sodium Hydroxide | 25.0 | 25.0 | 25.0 |
| Sodium Tripolyphosphate | 10.0 | 10.0 | 10.0 |
| Sodium Carbonate | 12.0 | 12.0 | 12.0 |
| Sodium Carboxymethyl-cellulose (65%) | 2.0 | 2.0 | 2.0 |
| Non-ionic Surfactant | 10.0[1] | 9.0[1] | 9.0[1] |
| Fluroescent Whitening Agent[2] | .4 | .4 | .4 |
| 2-methyl-2,4-pentanediol | — | — | 1.0 |
| 1,2-propanediol | — | 1.0 | — |
| $Na_2O/SiO_2$ Mole Ratio | 1.94 | 1.94 | 1.94 |

[1]Nonyphenol-ethylene oxide adduct with an average of 9.5 moles ethylene oxide per mole of nonylphenyl (SURFONIC N-95, Jefferson Chemical).
[2]4,4'-Bis[(4-anilino-6-morpholino-S-triazin-2-yl) amino]-2,2'-stilbenedisulfonic acid.
[3]Comparative Example 2.

Upon standing for 24 hours at 50° C. the composition of Comparative Example 2 turned from yellow/green (freshly made) to a dark green/dark brown (discolored), whereas Example 2 turned to a deep yellow (acceptable) and Example 3 remained yellow/green (acceptable).

COMPARATIVE EXAMPLES 3 THROUGH 7

The procedure of Examples 2 and 3 were utilized to prepare the detergent compositions. The detergent compositions were identical to that of Examples 2 and 3 except 1.0% of the indicated alcohol was utilized.

| Comparative Example | Alcohol | Initial Color | Final[1] Color |
|---|---|---|---|
| 3 | 1,2-ethanediol | Yellow/green | Dark brown |
| 4 | 1,2,3-propanetriol | Yellow/green | Brown/ yellow/green |
| 5 | polyethylene glycol | Yellow/green | Brown/ yellow/green |
| 6 | ethoxytriglycol | Yellow/green | Dark brown/ yellow |
| 7 | methoxytriglycol | Yellow/green | Dark brown/ yellow |

[1]After 24 hours at 50° C.

The final colors of Comparative Examples 3 through 7 were unacceptable.

EXAMPLES 4 THROUGH 7
DETERGENT COMPOSITIONS

Powdered detergent compositions were prepared by mixing the following ingredients:

| | EXAMPLES | | | | | |
|---|---|---|---|---|---|---|
| | Comp. 8[3] | 4 | 5 | Comp. 9[3] | 6 | 7 |
| Sodium Metasilicate | 27.7 | 27.7 | 27.7 | 72.8 | 72.8 | 72.8 |
| Sodium Hydroxide | 10.0 | 10.0 | 10.0 | 5.0 | 5.0 | 5.0 |
| Sodium Carbonate | 50.0 | 50.0 | 50.0 | 12.0 | 12.0 | 12.0 |
| Sodium Carboxy-methylcellulose (65%) | 2.0 | 2.0 | 2.0 | 2.0 | 2.0 | 2.0 |
| Non-ionic Surfactant | 10.0[1] | 9.0[1] | 9.0[1] | 7.5[1] | 6.5[1] | 6.5[1] |
| Fluorescent Whitening Agent[2] | 0.3 | 0.3 | 0.3 | 0.3 | 0.3 | 0.3 |
| Pine Oil | 0 | 0 | 0 | 0.4 | 0.4 | 0.4 |
| 1,2-propanediol | 0 | 1.0 | 0 | 0 | 1.0 | 0 |
| 2-methyl-2,4-pentanediol | 0 | 0 | 1.0 | 0 | 0 | 1.0 |
| $Na_2O/SiO_2$ Mole Ratio | 1.55 | 1.55 | 1.55 | 1.10 | 1.10 | 1.10 |

[1]Nonyphenol-ethylene oxide adduct with an average of 9.5 moles ethylene oxide per mole of nonylphenol (SURFONIC N-95, Jefferson Chemical).
[2]4,4'-Bis[(4-anilino-6-morpholino-S-triazin-2-yl) amino]-2,2'-stilbenedisulfonic acid.
[3]Comparative Examples.

Upon standing for 24 hours at 50° C., the following observations were made:

| Example No. | Initial Color | Final Color |
|---|---|---|
| Comp. 8[3] | Yellow/Green | Brown/Dirty Dark Green (Discolored) |
| 4 | Yellow/Green | Deep Yellow (Acceptable) |
| 5 | Yellow/Green | Yellow/Green (Acceptable) |
| Comp. 9[3] | Yellow/Green | Brown With/Yellow Green Particles (Discolored) |
| 6 | Yellow/Green | Brownish Yellow With/Yellow Green Particles (Acceptable) |
| 7 | Yellow/Green | Yellow/Green (Acceptable) |

[3]Comparative Examples.

Although the present invention has been disclosed in connection with a few preferred embodiments thereof, variations and modifications may be resorted to by those skilled in the art without departing from the principles of this invention. All of these variations and modifications are considered to be within the spirit and scope of the present invention as disclosed in the foregoing description and defined by the appended claims.

What is claimed is:

1. In an alkaline detergent composition in solid form consisting essentially of (by weight):

(i) about 45% to about 80% of a mixture of alkali metal silicate and alkali metal hydroxide, wherein the mixture has a mole ratio of $M_2O:SiO_2$, wherein M is alkali metal, of about 1.25:1 to about 2.25:1;

(ii) about 8% to about 35% of an alkali metal carbonate;

(iii) up to about 40% of an alkali metal condensed phosphate; and (iv) a nonionic surface active agent which is the condensation product of (A) an aliphatic alcohol with ethylene oxide, propylene oxide or mixtures thereof, or (B) an alkyl phenol with ethylene oxide, and is contained in the composition at about 7% to about 25%, said nonionic surface active agent having a tendency to discolor the composition, the improvement wherein the composition comprises a discoloring inhibiting amount of an alcohol of 3 to 10 carbon atoms having not more than one primary alcohol group and at least one secondary or tertiary alcohol group.

2. The composition of claim 1, wherein the alcohol has 3 to 6 carbon atoms.

3. The composition of claims 1 or 2, wherein the alcohol has at least one secondary alcohol group.

4. The composition of claims 1 or 2, wherein the alcohol has at least one tertiary alcohol group.

5. The composition of claim 1, wherein the alcohol is selected from the group consisting of 2-methyl-2,4-pentanediol and 1,2-propanediol.

6. The composition of claim 1, wherein the alcohol is 2-methyl-2,4-pentanediol.

7. The composition of claim 1, wherein the discoloring inhibiting amount is about 0.5% to about 3% by weight of the composition.

8. The composition of claim 1 wherein the mole ratio is about 1.75:1 to about 2.15:1.

9. The composition of claim 1 wherein the composition contains:

(i) about 30% to about 50% of an alkali metal silicate and (ii) about 15% to about 30% of an alkali metal hydroxide.

10. The composition of claim 1, wherein the alkali metal condensed phosphate is sodium tripolyphosphate.

11. The composition of claim 1, wherein the alkali metal silicate is sodium metasilicate.

12. The composition of claim 1, wherein the alkali metal silicate is about 35% to about 45%.

13. The composition of claim 1 wherein the alkali metal hydroxide is sodium hydroxide.

14. The composition of claim 1, wherein the alkali metal hydroxide is about 20% to about 30%.

15. The composition of claim 1, wherein the alkali metal carbonate is sodium carbonate.

16. The composition of claim 1, wherein the amount of alkali metal carbonate is about 10% to about 20%.

17. The composition of claim 1, wherein the nonionic surface active agent is the condensation product of an alkyl phenol with ethylene oxide.

18. A method of inhibiting the discoloration of an alkaline detergent composition in solid form consisting essentially of (by weight):

(i) about 45% to about 80% of a mixture of alkali metal silicate and alkali metal hydroxide, wherein the mixture has a mole ratio of $M_2O:SiO_2$, wherein M is alkali metal, of about 1.25:1 to about 2.25:1;

(ii) about 8% to about 35% of an alkali metal carbonate;

(iii) up to about 40% of an alkali metal condensed phosphate; and (iv) a nonionic surface active agent which is the condensation product of (A) an aliphatic alcohol with ethylene oxide, propylene oxide or mixtures thereof, or (B) an alkyl phenol with ethylene oxide, and is contained in the composition of about 7% to about 25%, said nonionic surface active agent having a tendency to discolor the composition, comprising adding to the composition a discoloring inhibiting amount of an alcohol of 3 to 10 carbon atoms having not more than one primary alcohol group and at least one secondary or tertiary alcohol group.

19. The method of claim 18, wherein the alcohol has 3 to 6 carbon atoms.

20. The method of claim 18 or 19, wherein the alcohol has at least one secondary alcohol group.

21. The method of claim 18 or 19 wherein the alcohol has at least one tertiary alcohol group.

22. The method of claim 18 wherein the alcohol is selected from the group consisting of 2-methyl-2,4-pentanediol and 1,2-propanediol.

23. The method of claim 18 wherein the alcohol is 2-methyl-2,4-pentanediol.

24. The method of claim 18 wherein the discoloring inhibiting amount is about 0.5% to about 3% by weight of the composition.

25. The method of claim 18, wherein the mole ratio is about 1.75:1 to about 2.15:1.

26. The method of claim 18, wherein the composition contains;

(i) about 30% to about 50% of an alkali metal silicate and (ii) about 15% to about 30% of an alkali metal hydroxide.

27. The method of claim 18 wherein the alkali metal condensed phosphate is sodiumtripolyphosphate.

28. The method of claim 18 wherein the alkali metal silicate is sodium metasilicate.

29. The method of claim 18, wherein the alkali metal silicate is about 35% to about 45%.

30. The method of claim 18 wherein the alkali metal hydroxide is sodium hydroxide.

31. The method of claim 18 wherein the alkali metal hydroxide is about 20% to about 30%.

32. The method of claim 18 wherein the alkali metal carbonate is sodium carbonate.

33. The method of claim 18 wherein the amount of alkali metal carbonate is about 10% to about 20%.

34. The method of claim 18 wherein the amount of nonionic surface active agent is about 8% to about 15%.

35. The method of claim 18 wherein the nonionic surface active agent is the condensation product of an alkali phenol with ethylene oxide.

36. A component for an alkaline detergent composition, said detergent composition containing an alkali material selected from the group consisting of alkali metal hydroxides, alkali metal silicates and mixtures thereof, said component comprising:

(a) at least one nonionic surface active agent having a tendency to discolor the alkaline detergent composition in the presence of the alkali material; and (b) a discoloring inhibiting amount of 2-methyl-2-4-pentanediol alcohol, wherein the weight ratio of nonionic surface active agent to alcohol is about 2:1 to about 50:1.

* * * * *